United States Patent [19]

Lancaster, III et al.

[11] 4,418,510

[45] Dec. 6, 1983

[54] STRETCH WRAPPING APPARATUS AND PROCESS

[75] Inventors: Patrick R. Lancaster, III, Anchorage; William G. Lancaster, Louisville, both of Ky.

[73] Assignee: Lantech, Inc., Louisville, Ky.

[21] Appl. No.: 255,222

[22] Filed: Apr. 17, 1981

Related U.S. Application Data

[63] Continuation of Ser. No. 74,786, Sep. 12, 1979.

[51] Int. Cl.[3] ..... B65B 11/04

[52] U.S. Cl. ..... 53/399; 53/441; 53/465

[58] Field of Search ..... 53/441, 399, 556, 582, 53/465

[56] References Cited

U.S. PATENT DOCUMENTS

| | | | |
|---|---|---|---|
| 2,854,697 | 10/1958 | Ryan . | |
| 3,589,091 | 6/1971 | Cloud | 53/556 |
| 3,672,116 | 6/1972 | Ingmarson | 53/556 |
| 3,843,761 | 10/1974 | Bierenbaum | 264/210 R |
| 3,867,806 | 2/1975 | Lancaster | 53/441 |
| 4,077,179 | 3/1978 | Lancaster | 55/556 |
| 4,079,565 | 3/1978 | Lancaster | 53/441 |
| 4,204,377 | 5/1980 | Lancaster | 53/556 |

FOREIGN PATENT DOCUMENTS

| | | | |
|---|---|---|---|
| 2750780 | 5/1979 | Fed. Rep. of Germany | 53/556 |
| 2281275 | 4/1976 | France | 53/556 |

*Primary Examiner*—John Sipos
*Attorney, Agent, or Firm*—John S. Hale

[57] ABSTRACT

A process and apparatus for applying stretchable plastic film to loads for containment of the loads using two connected sets of powered rollers driven at different speeds to elongate the plastic film beyond its yield point and simultaneously connecting the stretched film to a rotating load whose surface is moving at approximately the same rate of speed as the surface of the faster and final of the two sets of rollers. A powered or force loaded film accumulator such as a dancer bar can be added to compensate for corners of the load where significant length-width distortions exist. In addition, a web narrowing device may be placed upstream or downstream from the rollers to reduce the hazard of edge tear under high elongation forces. Closure of the film ends can be accomplished by a mechanical closure mechanism.

4 Claims, 12 Drawing Figures

STRETCH WRAPPING APPARATUS AND PROCESS

This is a continuation application of Ser. No. 074,786, filed Sept. 12, 1979.

BACKGROUND OF THE INVENTION

The present invention generally relates to packaging and more particularly to an apparatus and method for making unitary packages which hold a plurality of components, each package containing a load wrapped in a web of stretched film.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking the sleeve to form a unitized package. The use of heat shrinkable film is described in U.S. Pat. Nos. 3,793,798; 3,626,645; 3,590,509 and 3,514,920. A discussion of this art is set forth in U.S. Pat. No. 3,867,806.

The present invention does not require a structural seal and therefore can use any type of stretchable material. The invention is designed to function with stretchable film webs such as nylon, polypropylene, P.V.C., polybutylene, polyethylene or any copolymer or blends of the aforementioned stretchable films. The present inventive apparatus utilizes a fastening mechanism which effectively fastens a wrapping of collapsed film to an adjacent wrap while severing the trailing edge of the film web from the load after the load has been spirally wrapped to form a package overwrap.

The use of spiral wrapping machinery is well known in the art. One such apparatus is shown by U.S. Pat. No. 3,863,425 in which film is guided from a roll and wrapped around a cylindrical load in a spiral configuration. A carriage drives the film roll adjacent the surface of the load to deposit a spiral overwrap around the load and returns in the opposite direction to deposit another spiral overwrap around the load.

It has previously been disclosed in U.S. Pat. No. 3,788,199 to spirally wind tapes in a manner that they overlap each other to provide suitable space therebetween when breathability is required. In this reference, a heavy duty bag is prepared by spirally winding stretched tapes of synthetic resin in opposite directions, so that they intersect each other to form a plurality of superimposed cylindrical bodies which are bonded together to form a cylindrical network. The spirally wound inner and outer tapes of the superimposed cylindrical body intersect each other at a suitable angle, depending upon the application intended, the preferred embodiment having substantially equal longitudinal transfer strength. In this preferred embodiment the tapes intersect each other at an angle of about 90°. The angle defined by the tapes constituting the cylindrical network may be determined by varying the interrelationship between the travelling speed of the endless belts carrying the tape and the rotating speed of the bobbin holders, which rotate a plurality of tape bobbins to deposit the tape onto the moveable belt. The previously indicated patents rely on heat shrink material, adhesives, a heat seal or the tacky nature of the film to hold the outer layer of wrap in a fixed position.

In U.S. Pat. No. 3,003,297 a complex cutting and holding mechanism is used to place tape on a box and cut it off with the process being repeated for each box.

Additional references of interest which are pertinent to rotatable drives for wrapping packages are disclosed in U.S. Pat. Nos. 3,820,451; 3,331,312; 3,324,789; 3,309,839; 3,207,060; 2,743,562; 2,630,751; 2,330,629; 2,054,603; and 2,124,770.

Other applications in packaging are shown by U.S. Pat. Nos. 3,514,920 and 3,793,798 in which heat shrink film is wrapped around a pallet supporting a plurality of cartons. A similar full web apparatus using a tensioned cling film is shown by U.S. Pat. No. 3,986,611 while another apparatus using a tacky P.V.C. film is disclosed in U.S. Pat. No. 3,795,086.

The elasticity of the film or netting holds the products under more tension than either the shrink wrap or the kraft wrap, particularly with products which settle when packaged. The effectiveness of stretched plastic film in holding a load together is a function of the containment or stretch force being placed on the load and the ultimate strength of the total layered film wrap. These two functions are determined by the modulus or hardness of the film after stretch has occurred and the ultimate strength of the film after application. Containment force is currently achieved by maximizing elongation until just below a point where break of the film occurs. Virtually all stretch films on the market today including products of Mobil Chemical Company (Mobil X, Mobil C, Mobil H), Borden Resinite Division (PS-26). Consolidated Thermoplastics, Presto, PPD, and others consistently stretched less than 30% in field applications because of irregularities in film braking systems. These systems depend upon friction either directly on the film through a bar assembly such as that used by the Radient Engineering Company or indirectly as that shown in U.S. Pat. No. 3,867,806 and 4,077,179.

All of these prior art apparatuses suffer from a severe limitation which relates to cost per unit load for film unitization. Friction brake devices do not maintain a consistent force. These brakes are subject to variation due to their physical construction and their sensitivity to speed change caused by passage of corners of the load, and the resultant sudden speed up and slow speed down of film unwind. A typical 40"×48" pallet load will incur a surface speed change of more than 40% with each quarter turn. Higher turntable speeds of 12–18 RPM produce additional resonating forces which change with a roll consumption and its resultant weight change. Additional limitations on maximum elongation are caused by film roll imperfections and gauge variations which accentuate the force variations described above to produce film ruptures. Even though all of the film previously described carry manufacturer's specified elongation rates above 300%, these rates cannot be approached because of limitations imposed by friction-type constant force devices.

One problem with shrink and non-cling stretch film packaging in addition to the fact that they do not allow a lead to breathe is that the primary strength and reliability of the package is determined by the consistent quality of the seal. These seals depend on a careful maintenance of the sealing jaw and are never as strong as the film itself. The time that it takes to make the seals is a limiting factor on the possible speeds of most shrink systems with the additional problem that some stretchable materials, as for example, stretch netting, or narrow film width cannot be effectively heat sealed.

In view of the previously stated characteristics of film the previously noted stretch machines including machines manufactured by Lantech Inc.; Infra-Pak; PS & D; Radient Engineering, I.P.M.: and Mima have limited capabilities.

When high elongation rates are attempted, the forces frequently either disrupt the stacking pattern or pull the load off of the turntable.

In addition non-vertical sides and corners on an irregular load place extreme forces on a small area of film during stretching, thereby causing a partial rupture at a point well below the force achievable on a flat side. This partial rupture causes a transfer of force to the remaining portion of the web. This force is frequently sufficient to produce a "zippering" of the entire film web.

The present invention provides an apparatus and process which prestretches film before wrapping the film around a load so that the film may be stretched from 40 to 300% before it is wrapped around the load holding the load under compressive forces.

Most plastic films when stretched above their yield point gain significantly in modulus and ultimate strength. A typical polyethylene will multiply three times the ultimate strength in pounds per square inch of cross-sectional area after being elongated approximately 300%. This significant increase in strength begins approximately when the yield point is exceeded in elongation. The yield point is achieved between 15% and 40% stretch for virtually all stretch films being used today. Limitations of current friction-type constant force devices prevent current stretch wrap applications from achieving the higher levels of containment force and ultimate strength available in most plastic films. Achieving the higher elongation levels with the invention allows fewer revolutions of film for equipment holding power. These higher levels of stretch not only allow fewer revolutions of film but also less film by weight for each revolution. Cost savings of more than 50% will frequently result from using the present invention.

If irregular loads, unstable loads, or crushable loads are incurred, the film leaving the prestretching mechanism can be set to a surface speed equal to or slightly faster than the average surface speed of the pallet. Dramatic reduction of force on the film will give most of the advantages of high elongation rates without its crushing force. This reduction of force is caused by the non-elastic strain recovery because the yield point is exceeded and the rapid stress relaxation incurred at the high elongation level.

Very stable loads or loads not subject to crushing can take advantage of the maximum strength of the film by slowing the film leaving the prestretching mechanism to a surface speed below the average speed of the pallet load, to produce additional stretch forces over and above those achieved during the initial elongation.

SUMMARY OF THE INVENTION

A process and apparatus for applying stretchable plastic film to pallet loads for containment of the loads using two connected sets of powered rollers driven at different speeds to elongate the plastic film beyond its yield point and simultaneously connecting the film to a rotating pallet whose vertical surface is moving at approximately the same rate as the surface of the faster and final of the two sets of rollers. Where irregular or unstable loads are wrapped, the surface speed of the final roller can be increased above the surface speed of the load thereby avoiding disruptive forces on the load or tearing forces on the film. Relatively rigid and regular loads can utilize the maximum strength of the film by slowing the surface of the final roller to below the surface speed of the pallet load, to incur additional elongation and unitizing force. A powered or force-loaded film accumulator such as a dancer bar can be added to compensate for corners where significant length-width distortions exist. A web narrowing device may be placed upstream or downstream from the rollers to reduce the hazard of edge tear under high elongation forces. Closure of the film ends can be efficiently accomplished by a mechanical closure mechanism.

The above mentioned purposes and operations of the invention are more readily apparent when read in conjunction with the following description of the drawings and the detailed description of the preferred embodiment of the present invention.

BRIEF DESCRIPTION OF THE DRAWINGS

FIG. 3 is a reduced elevational front view of the inventive apparatus shown in FIG. 2;

DETAILED DESCRIPTION OF THE DRAWINGS

Figure 1:
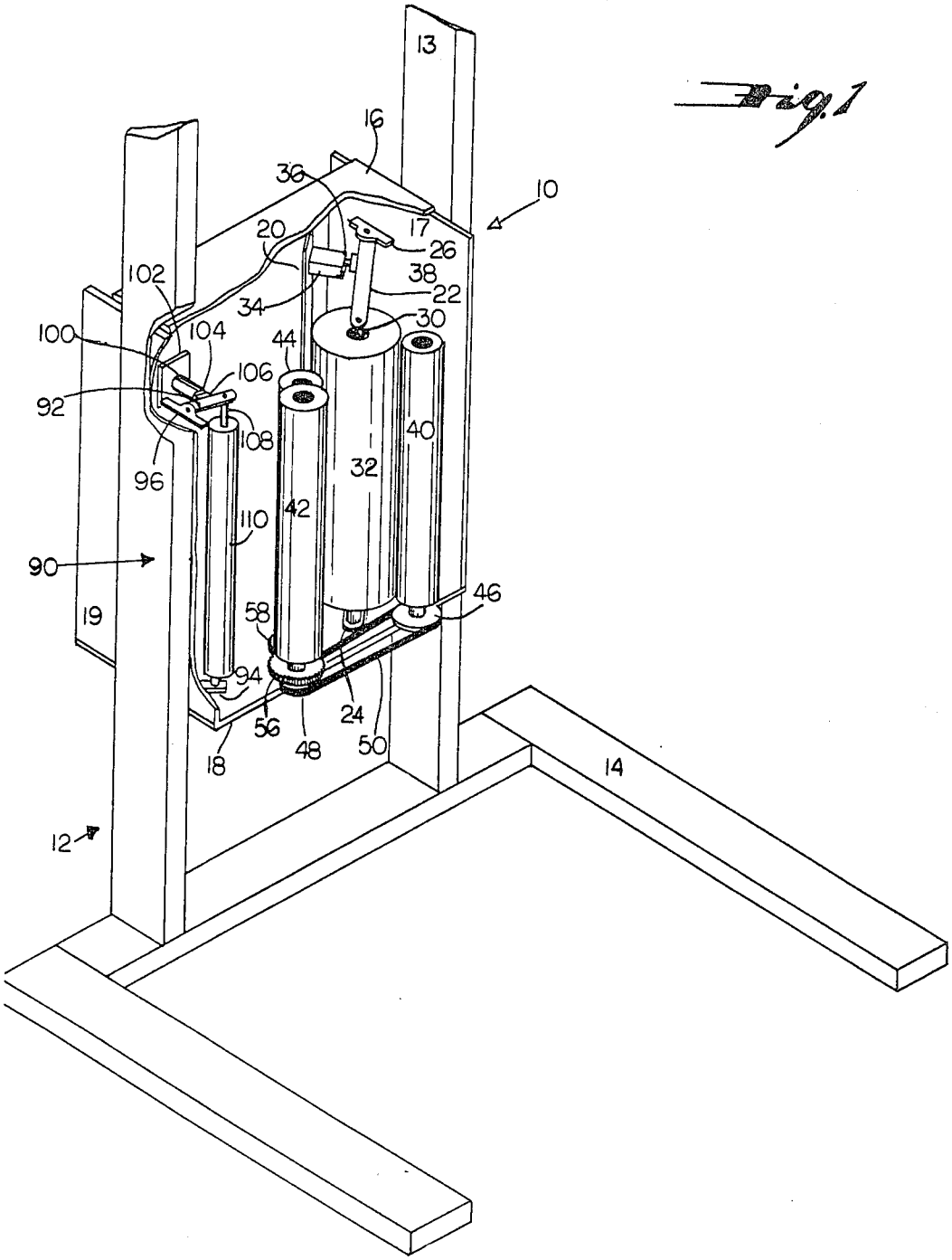
FIG. 1 is a perspective view of the inventive apparatus with a portion of the apparatus broken away.

The improved wrapping apparatus 10 is shown in FIGS. 1 through 12 with the preferred mode of the invention being shown in FIGS. 1 through 4 and the mechanical closure of the invention being shown in FIGS. 5 through 12. The operation and description of the apparatus and its respective component parts are discussed in the following description.

The powered stretch wrapping apparatus 10 comprises an upright frame 12 sitting on a base 14. In the preferred embodiment of the invention a carriage 16 is movably mounted on frame 12 as is known to the art and is driven by rack and pinion, chain or other suitable drive means. A rack type drive is shown in FIG. 3. Such stretch wrapping machines are well known in the art and are disclosed by machine Model Nos. SVS-80, SVSM-80, STVS-80, STVSM-80 and SAHS-80, manufactured by Lantech Inc. The apparatus 10 may also be a full web apparatus with the carriage removed as is also well known in the art. Such machines are typified by Model Nos. S-65, SP-65 and SAH-70, manufactured by Lantech Inc. A typical state of the art full web machine is also disclosed in U.S. Pat. No. 3,867,806. Other machines which could use the present invention are machines which rotate the film around the load rather than rotation of the turntable carrying the load. Such apparatus is disclosed in U.S. Pat. Nos. 4,050,220 and 4,110,957 and are assigned to Lantech Inc. These patents are incorporated by reference into the specification of this application. In the embodiment as most clearly shown in FIGS. 1 and 2, a support bar 20 is secured to the carriage wall 16 and 18. Pivotal support arms 22 and 24 are pivotally mounted to brackets 26 and 28 respectively, which are in turn secured to the side wall 17 of the carriage or alternately, may be secured to an upright standard 13 of the frame 12. A rotatable shaft 30 is mounted on the ends of the pivotal support arms and is adapted to receive and hold a film roll 32.

The film roll is preferably a rolled film web 32 of stretchable nature. Stretch films which can successfully be used with the apparatus are Mobil X, Mobil C, Mobil H, Mobil Y, Borden PS-26, Consolidated Thermoplastics EVA, Presto, St. Regis and P.P.D. Bemis Stretch Net is also useable in the apparatus. Excellent results have been achieved using linear low density polyethylene.

An air cylinder 34 is mounted to the support bar 20 and has an associated piston arm 36 which is connected to arm 22 by connector member 38. The air cylinder 14 is adapted to drive arm 22 and film roll 32 forward to press the film roll against a resilient rubber-type driver roller 40 constructed of polyurethane, preferably having a durometer of between 42 and 52. Positioned adjacent to roller 40 is a second set of two similarly constructed rollers 42 and 44. Roller 40 has a sprocket 46 and roller 42 has a sprocket 48. The first roller 40 and the second roller 42 have different sized sprockets so that the surface movement of the first roller 40 is at least 40% slower than the second set of rollers 42,44. The sprockets are sized depending on the amount of film elongation desired. Thus, the surface movement of the first roller 40 can be about 40%, 75%, 200% or 300% slower than the surface movement of the second set of rollers to obtain prestretching of 40%, 75%, 200% or 300%. While stretching normally ranges from 40 to 300%, excellent results have been obtained when narrower ranges of prestretching are required such as stretching the material 40% to 75%, 75% to 200%, 200% to 300%, and at least 100%. In certain instances, prestretching has been successful at over 300% of stretch. The rollers 40 and 42 are connected by a drive chain or belt 50. As best seen in FIG. 3, both sets of rollers are driven by a variable speed D.C. motor 52 through a reducer 54 connected to a shaft 55 of roller 42. It is apparent that the reducer 54 could be connected to either one of the rollers. The rollers are provided with pinion gears 56 and 58 to accomplish the driving.

Figure 2:
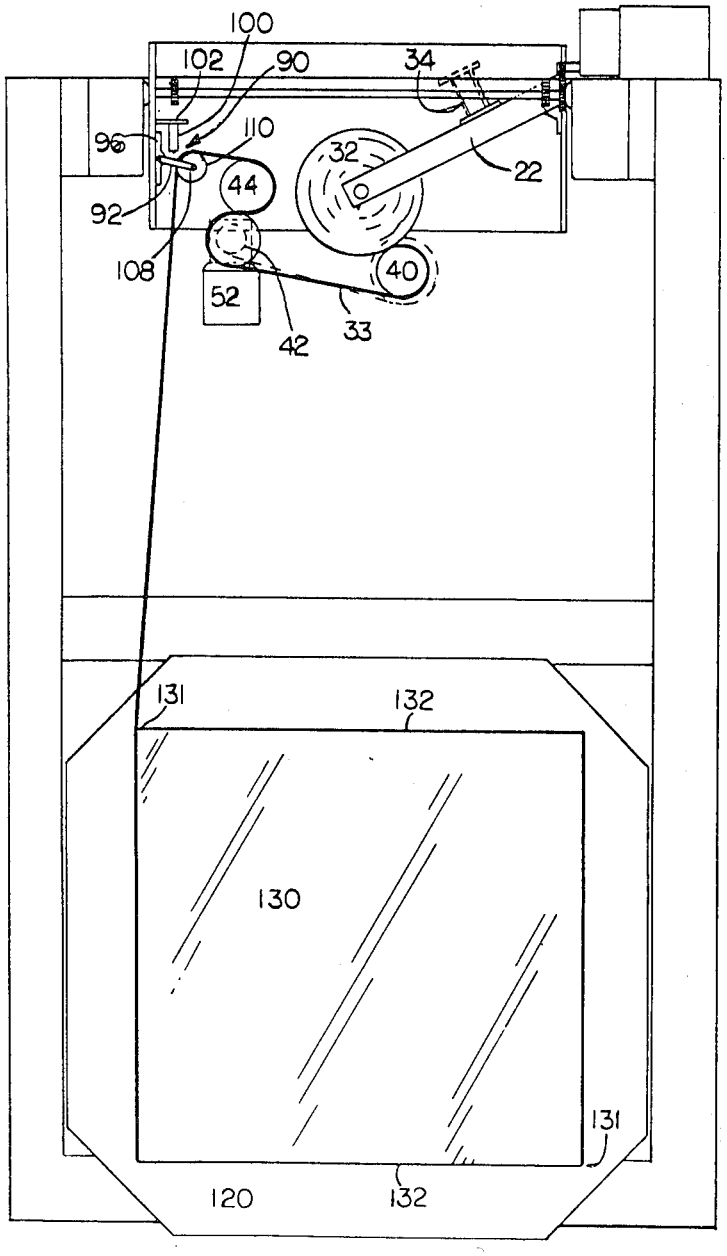
FIG. 2 is a plan view of the inventive apparatus shown in FIG. 1.
Figure 5:
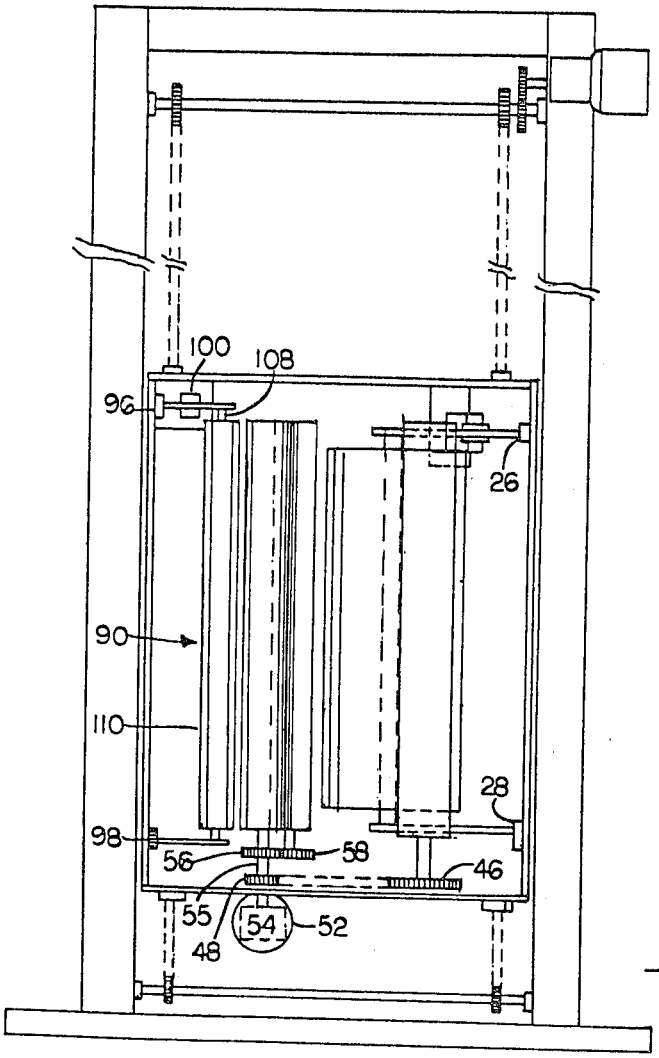
FIG. 5 is an enlarged partial top plan view partially in section of the clamping assembly and tying assembly of the inventive apparatus.
Figure 4:
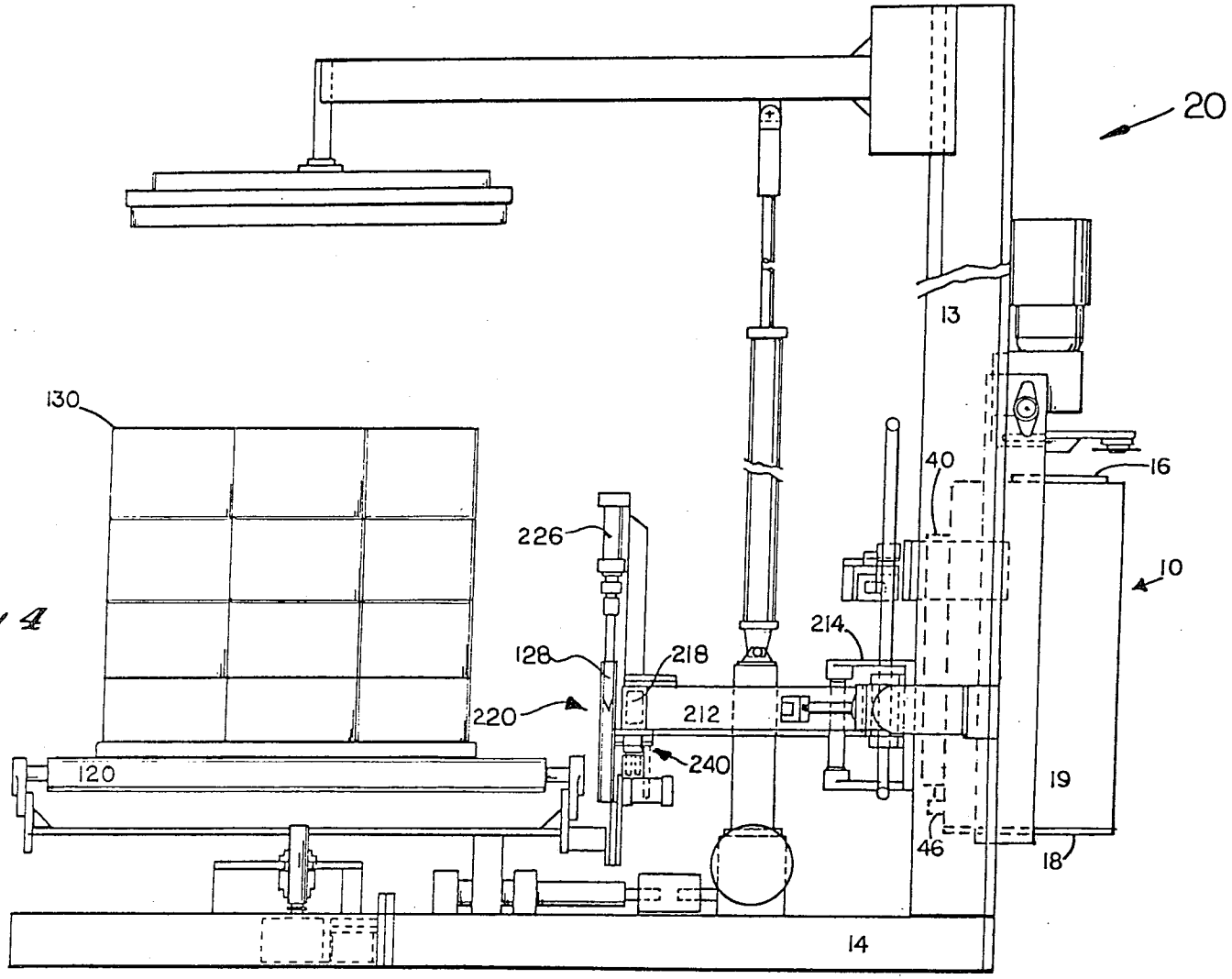
FIG. 4 is a partial side elevational view of the invention and pallet.
Figure 5:
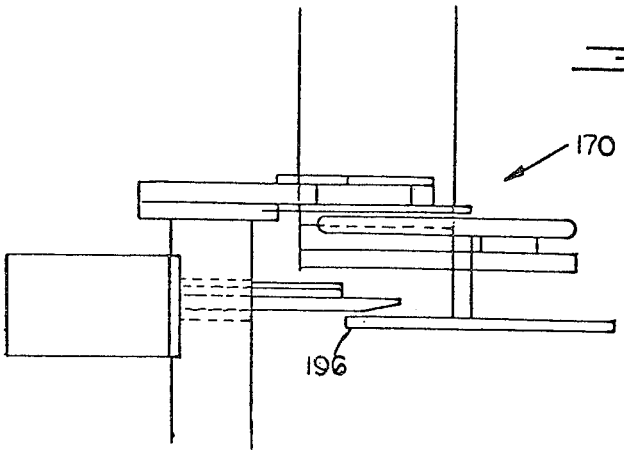
Figure 6:
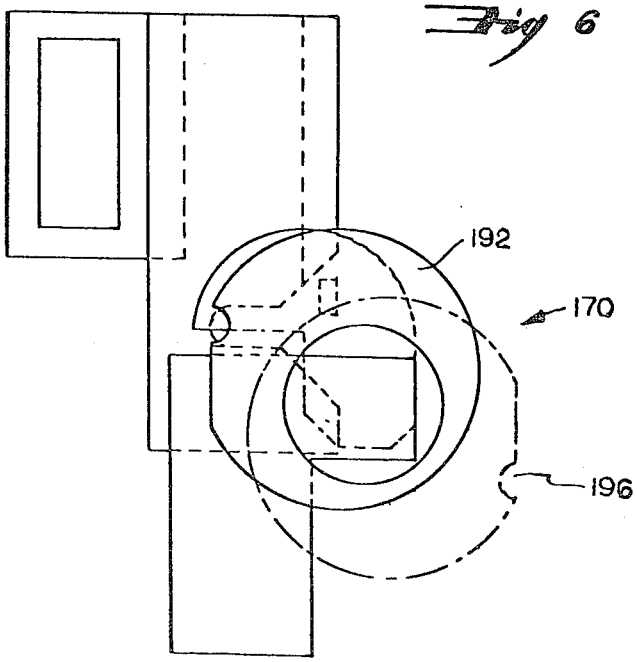
FIG. 6 is a side elevational view of the clamping assembly shown in FIG. 8 showing the position of the assembly when rotated in phantom.
Figure 7:
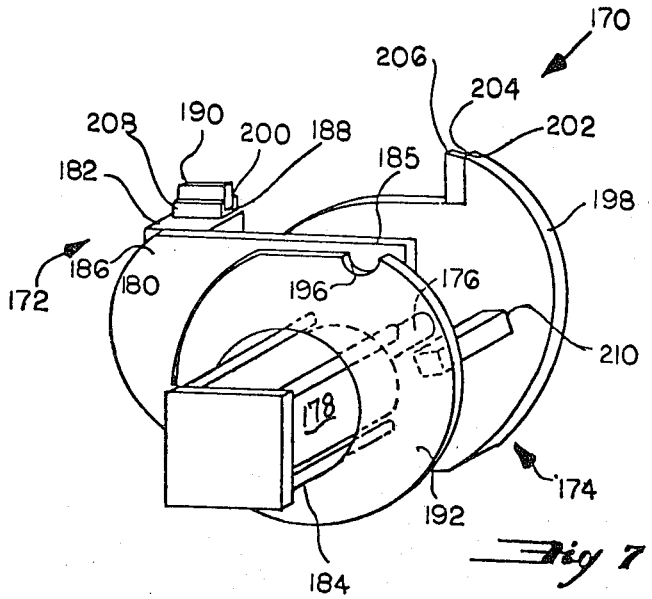
FIG. 7 is an enlarged isolated perspective view of the clamping assembly of the apparatus in an open position.
Figure 12:
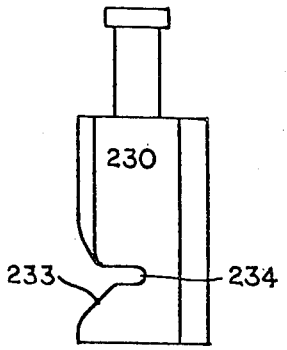
FIG. 12 is a side elevational view of the cutter mechanism housing.
Figure 8:
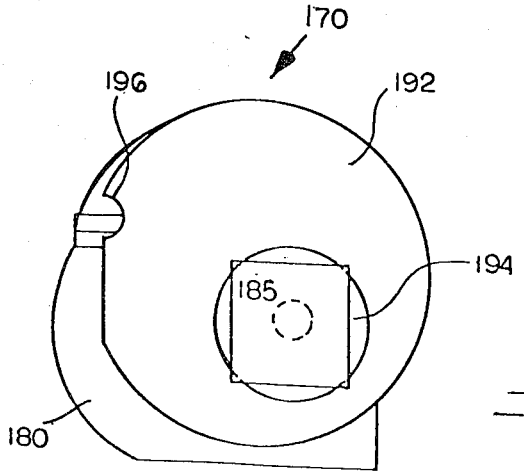
FIG. 8 is a side elevational view of the clamping assembly of the apparatus.

Alternate embodiments of the powered mechanical rollers producing elongation of the film because of the different surface speed of the rollers can be utilized in place of the best mode of the invention which is disclosed in FIGS. 1-3. For example, two sets of rollers having individual rollers powered and connected by a belt or other suitable drive can be used. The film web 33 from film roll 32 could also be drawn around idle rollers through the action of powered rollers to get traction and elongate the film. Alternately, one powered roller can pull the film web 33 from the film roll 32 directly with a brake engaging the film roll, holding it back so it is elongated as it passes over the idle rollers. Thus, it can be seen that the film is stretched between symmetrical round rollers, rather than between the film roll and rectangular pallet as has been the case in the previous prior art, to stretch the film well above the yield point to take advantage of the higher containment force and ultimate strength available.

Positioned adjacent to the second set of rollers, as best shown in FIGS. 1 through 3, is a horizontally movable, vertically oriented accumulator mechanism 90. The accumulator mechanism comprises two pivotable support arms 92 and 94 which are respectively mounted to brackets 96 and 98. The brackets are secured to side wall 19 on the frame. An air cylinder 100 is secured to a support bar 102 with the piston arm 104 of the air cylinder being connected to support arm by connector member 106. A rotatable shaft 108 holds roller 110 for movement thereon so that film can be accumulated in anticipation of corner passage of the film web around the pallet load. The roller 110 is positioned to let out extra film as the corner 131 of the load 130 passes and regains the excess film while the flat side 132 passes. This can be accomplished positively by limit switch actuations on the turntable. The accumulator can also hold a constant force with a spring or through air cylinder 110 thereby smoothing the corner passage. An alternate mechanism to accomplish the same result utilizes means to sense the corner passage of the pallet and electrically determine the passage so that the speed of the D.C. motor is modified or changed. This changes the speeds of both sets of rollers in unison so that the speed of the film coming off the rollers is synchronized to compensate for the corner passage of the load.

In operation of the apparatus 10, the film web 33 is threaded around the first roller 40 and then between the second set of rollers 42 and 44 around the accumulator roller 110, and then attached to the pallet load 130 or turn table clamp (not shown, but well known in the art). The turntable 120 and roller drive is actuated simultaneously causing film web 33 to be unwound from the film roll 32 at controlled speed. The second set of rollers 42,44 is mechanically interconnected to rotate at a faster surface speed than roller 40. The speed difference of the interconnected rollers produces a precise level of elongation independent of force required or gauge variation. The film web 33 is supported over its full width by smooth resilient parallel surfaces of the rollers. The stretched film is then passed around the accumulation mechanism 90 to the load 130 without the need for relatively additional stretch or additional force.

If irregular, unstable or crushable loads are encountered, the second set of rollers 42,44 can be set to a surface speed equal to or slightly faster than the average surface speed of the load 130. A reduction of force on the film will give most of the advantages of high elongation rates without its crushing force. This reduction of force is caused by the non-elastic strain recovery because the film web has exceeded the yield point and the rapid stress relaxation incurred at the high elongation level.

Stable loads or loads not subject to crushing can take advantage of the maximum strength of the film by slowing the second set of rollers to a surface speed below the average speed of the pallet load, to produce additional stretch forces over and above those achieved during the initial elongation.

In addition, certain types of high modulus films or films stretched significantly above the yield point may require positive corner compensation as provided by the accumulation device 90. The roller 110 is positioned to let out extra film as the corner 131 passes and regain excess film while the flat side 132 passes. This can be accomplished positively by positioning limit switches on the turntable 120. Such positioning is well known in the art. The accumulator can also hold a constant force with a spring or air cylinder thereby smoothing the corner passage.

The final film web end 33 can be brushed onto the underlying film layers on the load, tucked heat sealed or fastened by a mechanical closure mechanism. In the preferred embodiment, the mechanical closure mechanism is utilized with the invention.

Figure 9:
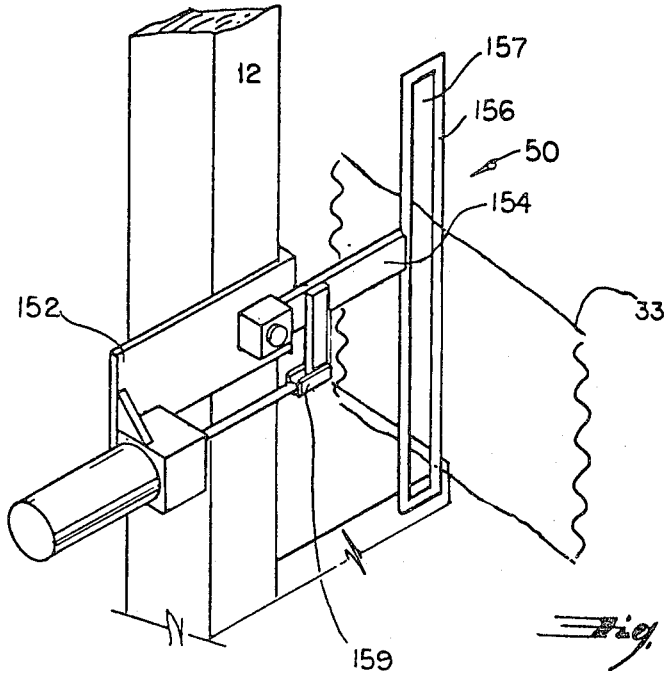
FIG. 9 is a partial perspective of the web width changing mechanism of the apparatus when the web is in a full width open position.
Figure 10:
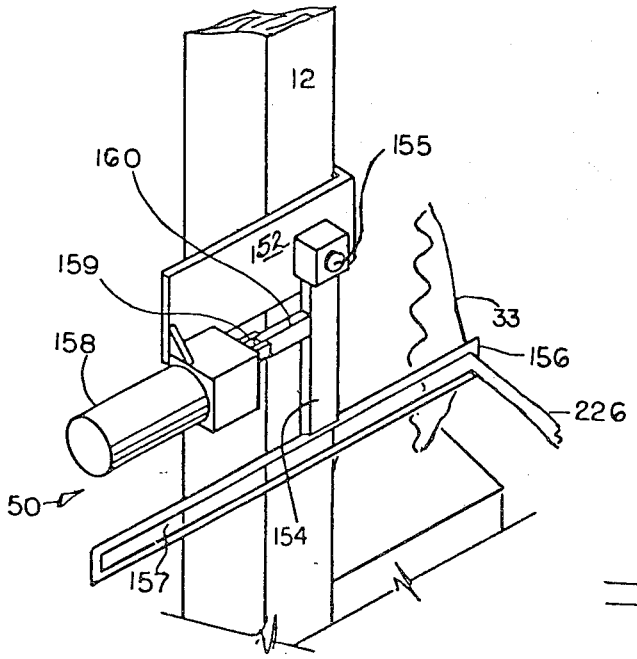
FIG. 10 is a partial perspective view of the web width changing mechanism when the mechanism is rotated to collapse the web into a rope.
Figure 11:
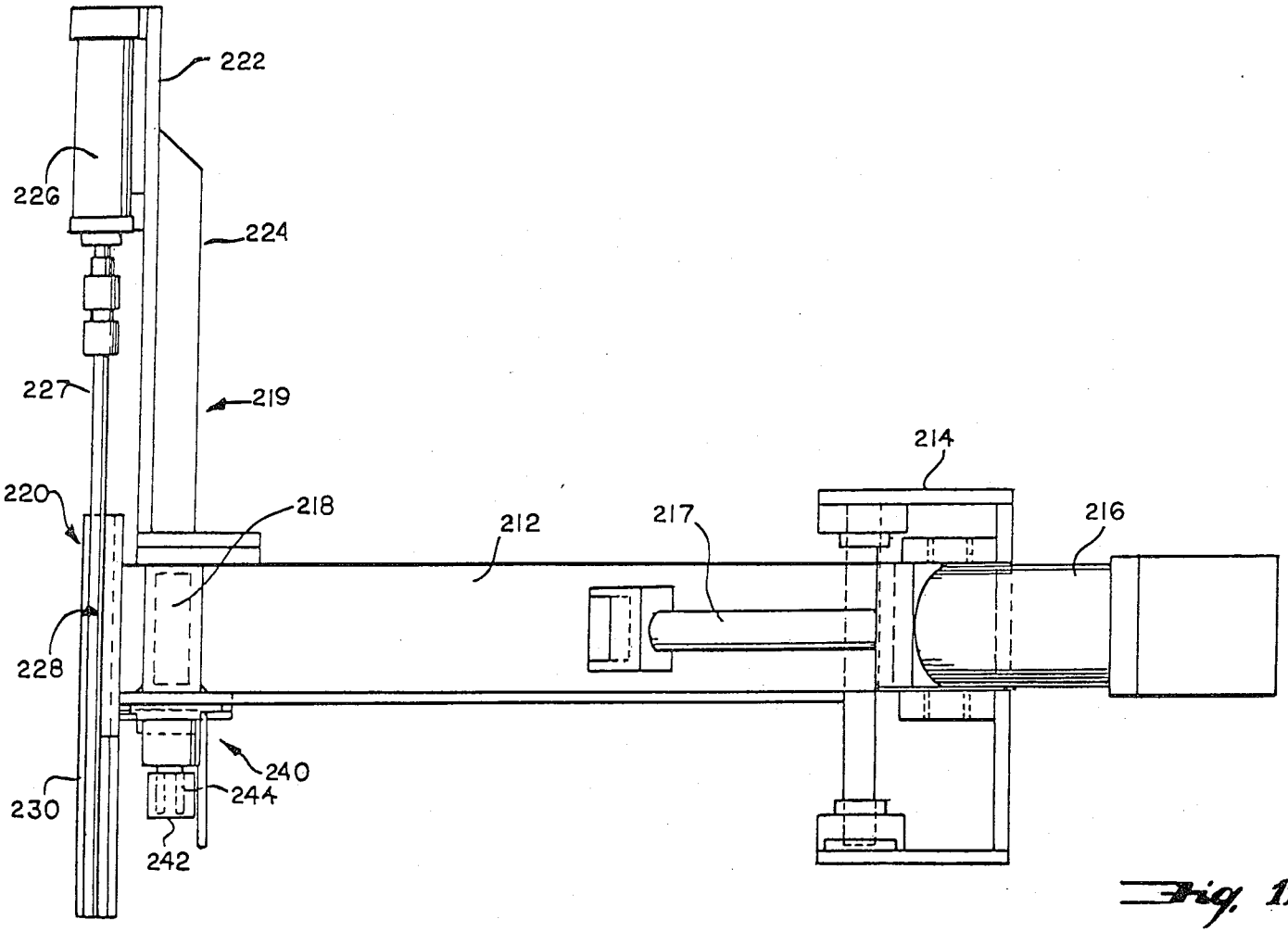
FIG. 11 is an enlarged side elevational view partially in cross-section of the cutter mechanism of the apparatus and the tying assembly of the apparatus.

It should be noted that film, film material and netting are used interchangeably through the specification. The film web 33 as it comes off the accumulator mechanism 90 passes through a roper mechanism 50. The roper mechanism which is best shown in FIGS. 9 and 10 comprises a support plate 152 secured to the frame 12 and a rotatable support bar 154 having one end rotatably mounted to the support plates, the other end being secured to the web reduction member 156.

The web reduction member 156 comprises a rectangular shaped bar which defines a rectangular aperture 157. The length of the rectangular aperture is greater than the width of the web of the material used for wrapping the load and the width of the rectangular aperture is greater than the thickness of the web. Preferably it is also equal to the desired thickness of the web when bunched or roped, so that when member 156 is rotated, web material 224 is roped into a diameter substantially equal to or less than the width of aperture 157 as is best shown in FIG. 10.

A pneumatically activated cylinder 158 is secured to the support plate 152 or the frame and has an end 159 of its piston rod rotatably connected to drive bar 160 which is in turn secured to the rotatable support bar 154. The cylinder 158 can be energized by known fluid circuitry to move the rotatable support bar, so that it rotates around pivot point 155 carrying the web reduction member 156 upward or downward in an approximately 90° arc. This causes the material web to be formed into a roped configuration 226 when the rectangular member is parallel to the ground or alternatively allows free flow of the open web through the web reduction member 156 when the web reduction member is positioned substantially perpendicular to the ground.

The material web when roped passes through a clamping assembly 170 mounted to the edge of the turntable.

The clamp assembly 170 comprises a stationary arm mechanism 172 and a rotatable clamp mechanism 174 mounted to a shaft 176 which is rotated by a rotary pneumatic cylinder 178.

The stationary arm mechanism 172 comprises a support block 180 mounted to turntable 308, a seat support 182 secured to the support block 180 and a cylinder support subassembly 184 secured to the support block. The support block has its rear portion 185 secured to the pneumatic cylinder and its forward portion 186 secured to the stationary seat support 182. The seat support 182 has a "U" shaped seat 188 with a resilient friction member 190 made of rubber or other suitable resilient material secured in the seat and extending above the legs 200 and 208 of the "U" shaped seat 182 for engagement with clamp arm 198 of the rotary clamp mechanism 174. The rotary clamp mechanism 174 comprises a material guide member 192 of an eccentric shape having a circular aperture 194 of suitable diameter surrounding the pneumatic cylinder 174 so that the guide member 192 can freely rotate around the pneumatic cylinder. A curved surface notch 196 is cut inward from the exterior edge of the material guide member 192 a suitable distance which allows the notch to receive and guide the roped material during the tying and severing operation of the apparatus.

The clamp arm 198 is secured to a spacer bar 210 which is secured in turn to the guide member 192. The clamp arm 198 has a cut away segment 202 which approximates a curved "L" shaped surface forming the contact surface for engagement with the resilient friction member 190. The segment 202 has a planar surface 204 adapted to engage the resilient friction member 190 to hold the roped material therebetween. The outwardly extending leg 206 of the "L" is adapted to be positioned adjacent the leg 208 of the seat 188 to engage the stretched material at the smallest angle of extension from the wrapped package.

A cutting mechanism 220 and tying mechanism 240 are secured to a moveable arm 212 which sequentially moves the mechanisms into the path of the material for the severing and tying steps. The arm 212 is rotatably mounted on support structure 214 and is driven by pneumatic cylinder 216 secured to the frame 222. Extension of the piston arm 217 of cylinder 216 drives the arm and the associated cutting and tying mechanism into the material path so that the mechanism can perform its desired function. Secured to the traversing arm 212 are a perpendicularly extending arm 218 which holds the tying mechanism 240 and a support structure 219 which is mounted to the top of the arm and supports the cutting mechanism 220. The cutting mechanism 220 comprises an upright support plate 222 and traverse brace 224 secured to the support plate and a piston 226 which is secured to the upright support plate 222. A piston arm 227 extends from the piston, the distal end of which is secured to a cutting blade 228. The cutting blade 228 is reciprocally positioned in a guillotine sheath or housing 230, which is secured to the end of traversing arm 212. The guillotine sheath 230 comprises a plate structure having an inwardly inclined notch 233 cut into one side adapted to receive the roped material and direct it into a center of the notch 234. The roped material when held in cutting notch 234 is severed by reciprocating action of the cutting blade 228 striking the roped material and cutting through the roped material.

A standard hog ringer device 242 such as that made by ATRO Company, types I and C is secured to the lower part of arm 219. A magazine 244 extends perpendicularly from the mechanism to feed staples or hog rings into the mechanism. In operation of such a standard hog ringer the shaped nose of the hog ring engages the materials to be tied together and a ring or staple is driven around the material held in the nose of the ring and fastened around materials by bending the ring or staple around the items to be tied. Thus, the two roped web layers which have been placed side by side are fastened together through the action of the hog ring passing a staple around both of the ropes and fastening or tying them together through the contraction of the staple or bending of the staple or ring around the materials.

It should be noted that the steps of the wrapping process can be interchangeable without departing from the scope of the invention. Furthermore, these steps can be interchanged and are equivalent.

In the foregoing description, the invention has been described with reference to a particular preferred embodiment although it is to be understood that the specific details shown are merely illustrative and that the invention may be carried out in other ways without departing from the true spirit and scope of the following claims.

What is claimed is:

1. A process of making a unitary package by wrapping a plurality of units with a stretched plastic material overwrap forming a unitary load comprising the steps of:

a. placing a load on a support;

b. positioning a roll of stretchable plastic material on a dispenser means adjacent to said support;

c. withdrawing a leading end of said plastic material from said dispenser means and passing said plastic material through a powered prestretch device adapted to drive the plastic material at a proportional speed with respect to the surface speed of the load, said prestretch device comprising a powered roller assembly with at least one rotationally restrictive roller assembly, said rotationally restrictive roller assembly being retarded to a substantially constant relative speed with respect to the rotationally powered roller assembly so that the plastic material is elongated substantially above its yield point between the roller assemblies, thereby changing strength characteristics and cross-sectional area of the plastic material;

d. holding said plastic material adjacent said load and simultaneously prestretching said plastic material substantially above the yield point by driving said prestretch device and causing relative rotation between said load and said dispenser means at a predetermined speed;

e. substantially reducing the force on the plastic material while maintaining the majority of the elongation incurred in said powered prestretch device through inelastic strain recovery after it leaves the powered prestretch device; and f. covering the load with previously elongated plastic material so that the units of the load are held under a compressive force.

2. A process for spirally wrapping a web of stretched film on a load comprising a plurality of units to form a unitary package, which process is repeated in a commercial environment comprising the steps of:

a. withdrawing film from a film roll through a powered prestretch means comprising a powered roller assembly and at least one restrictive roller assembly interconnected by speed control means and retarded to maintain a substantially fixed relative speed, the speed of the restrictive roller assembly being less than said powered roller assembly, and holding the film adjacent to the load;

b. activating the powered prestretch means to drive the film at a downstream speed increased from its upstream speed to produce film elongation above one hundred percent and the yield point of the film;

c. forming a spiral wrap around the load by causing relative rotation of the load and the powered prestretch means while substantially reducing film stress and maintaining a majority of film elongation incurred in said powered prestretch means through inelastic strain recovery between the load and the powered prestretch means;

d. forming a fastened web section by fastening a leading film portion of the wrap to a trailing film portion of the wrap; and e. severing said film between the film roll and the fastened web section.

3. A process for spirally wrapping a stretched plastic film web on an angular load comprising a plurality of units to form a unitary package comprising the steps of:

a. withdrawing the film web from a film web roll through a powered prestretch device comprising a positively rotationally powered downstream roller assembly and a rotational restricted upstream roller means, and holding the film web adjacent a load;

b. activating the prestretch device to drive the film web at a downstream speed on the powered roller assembly which is substantially greater than an initial upstream film web speed on the retarded upstream roller means sufficient to produce a film web elongation above one hundred percent and substantially above the yield point of the film web;

c. simultaneously initiating relative rotation of the load and the film web roll to achieve a force on the film web from the roller assembly to the load which is less than the force on the film web in the prestretch device while maintaining a majority of the elongation incurred in said prestretch device to produce inelastic strain recovery of the film web as it is wrapped around the load;

d. spirally wrapping the load;

e. fastening a trailing end of the film web to an underlying film web layer; and f. severing the film web from the load.

4. A process of making a unitary load by wrapping a plurality of units with a stretched plastic film web overwrap forming a unitary load comprising the steps of:

a. elongating the film web in a prestretching means at least fifty percent over the yield point while obtaining elongation of the film web over one hundred percent by subjecting the film web to differential surface speeds through engagement of a powered roller and a restricted roller, said restricted roller being retarded thereby causing said film web to elongate and gain substantially in strength per corss-sectional area and modulus;

b. wrapping the load with prestretched film web by causing relative movement between said prestretching means and said load while reducing the force on the film web from the prestretching means to the load substantially below the force applied to stretch the film web in the prestretching means and retaining the majority of the elongation through inelastic strain recovery between the prestretching means and the load.

* * * * *